United States Patent [19]

Gongwer

[11] 4,424,042

[45] Jan. 3, 1984

[54] PROPULSION SYSTEM FOR AN UNDERWATER VEHICLE

[75] Inventor: Calvin A. Gongwer, Glendora, Calif.

[73] Assignee: The Bendix Corporation, Southfield, Mich.

[21] Appl. No.: 286,127

[22] Filed: Jul. 23, 1981

[51] Int. Cl.[3] ..... B63H 1/18; B63H 11/08; B63H 19/06; B63H 23/26

[52] U.S. Cl. ..... 440/44; 114/338; 416/20 R; 416/90 A

[58] Field of Search ..... 114/312, 337, 338; 440/5, 44, 45, 49; 416/20, 90 A, 20 A, 20 D, 20 R

[56] References Cited

U.S. PATENT DOCUMENTS

| | | | |
|---|---|---|---|
| 2,428,191 | 9/1947 | Alterio | 440/44 |
| 2,511,156 | 6/1950 | Glass | 416/20 R |
| 3,188,497 | 6/1965 | Christensen | 440/45 |
| 3,273,333 | 9/1966 | Roulund | 440/44 |
| 3,288,100 | 11/1966 | Cox | 440/44 |
| 3,402,555 | 9/1968 | Piper | 440/44 |
| 3,643,438 | 2/1972 | Barsby | 440/45 |
| 4,188,406 | 2/1980 | Tachmindji | 416/90 A |

FOREIGN PATENT DOCUMENTS

| | | | |
|---|---|---|---|
| 884751 | 11/1971 | Canada | 416/20 A |
| 1334497 | 10/1973 | United Kingdom | 440/44 |

*Primary Examiner*—Galen L. Barefoot
*Assistant Examiner*—C. T. Bartz
*Attorney, Agent, or Firm*—Robert C. Smith; W. F. Thornton

[57] ABSTRACT

A propulsion system for an underwater vehicle includes a solid propellant gas generator producing gas which drives a gas turbine. The turbine drives one, or alternately two, centrifugal pumps which induct sea water from intake ports and supply it under pressure through a passage to passages leading to tip nozzles in the blades of a propeller which drives the vehicle, thereby using the reaction force from the tip nozzles to drive the propeller. Exhaust gas, after driving the turbine, is conducted through a conduit and to an annular chamber where it is cooled by means of a spray of sea water, thus condensing the steam present and reducing the volume of exhaust gas. The exhaust gas is then connected to the base of the propeller blades where it is exhausted into a low pressure region or, alternately, into passages in blades parallel to the water conduits such that the gas flow is exhausted at the propeller tips adjacent the water nozzles, thus ventilating the cores of the tip vortices emanating from each blade into which the water jets are discharged. Thus an external eductor is created which is actuated by the water jets and which compresses the exhaust to ambient pressure, thus lowering the back pressure on the thermal engine, be it a turbine or positive displacement type.

5 Claims, 7 Drawing Figures

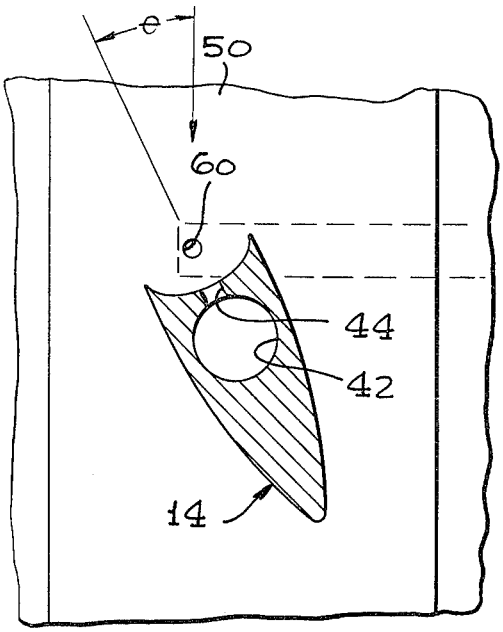
FIG. 3
FIG. 2
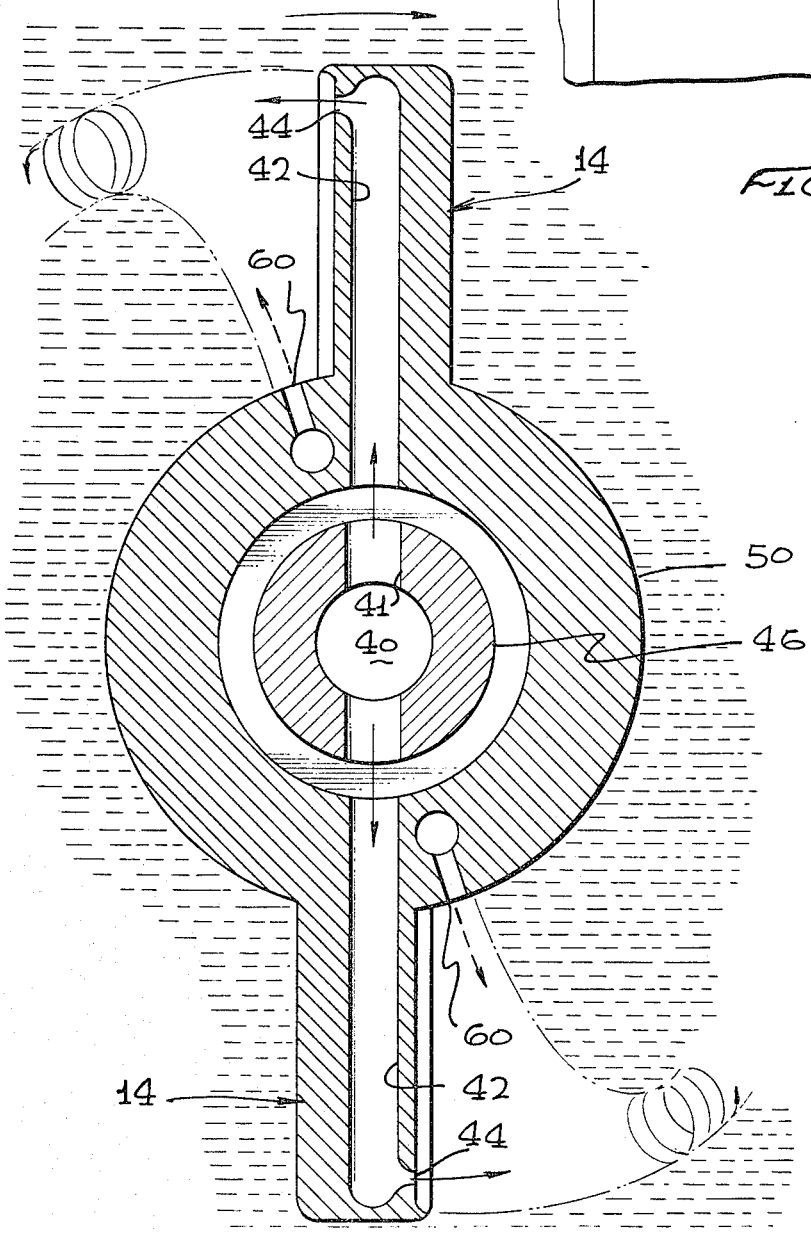

FIG. 5
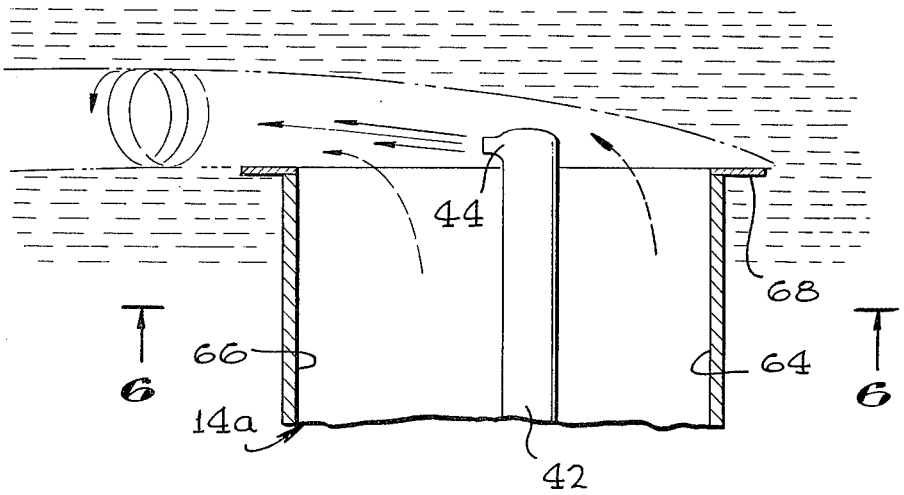
FIG. 6
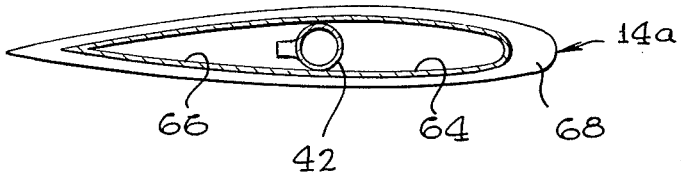
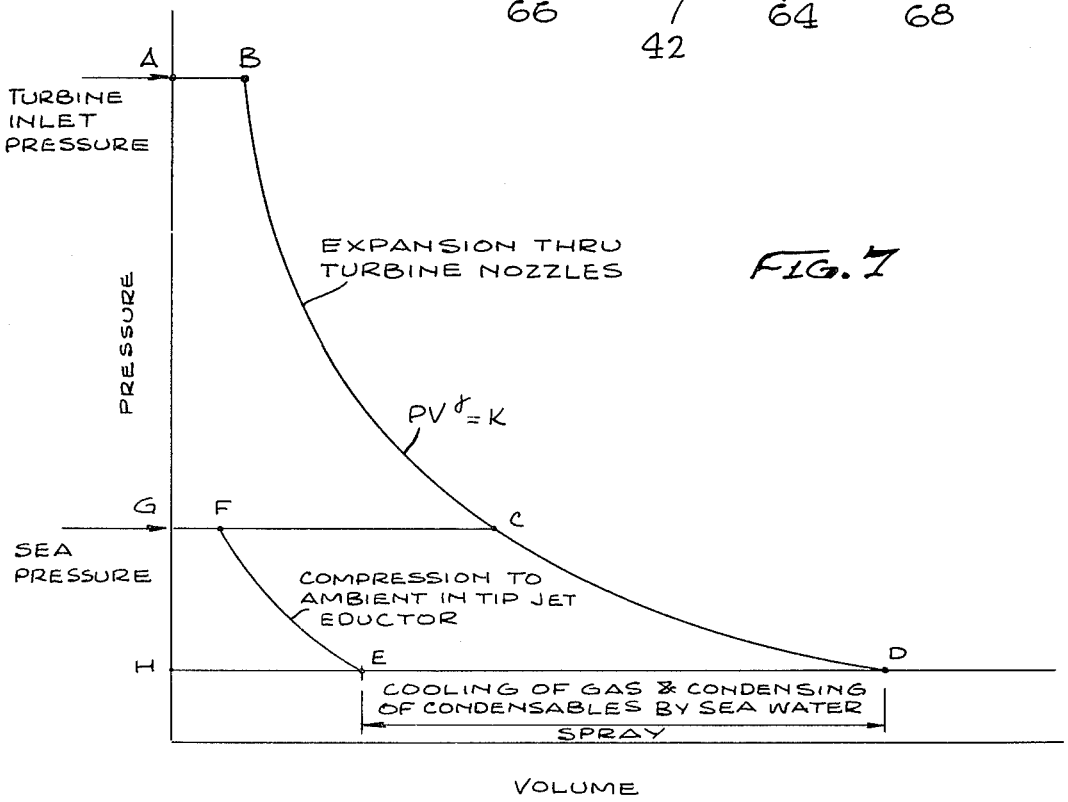
FIG. 7

PROPULSION SYSTEM FOR AN UNDERWATER VEHICLE

This invention relates to a propulsion system for an underwater vehicle.

The several types of propulsion which have been used for underwater vehicles have been chosen with various requirements in mind, a principal such requirement being the length, in time, of the underwater run. Solid propellant rocket engines have been used successfully where the underwater run was only a few seconds. For applications requiring longer run times, however, rocket propulsion is too inefficient. Various means of augmenting the thrust of an underwater rocket have been proposed. These are generally aimed at using entrained water to increase the mass flow rate while decreasing the velocity of the exhaust stream. The solid propellant gas generator has also been used to provide an exhaust stream which is directed through a gas turbine which then, through a reduction gearbox, turns a propeller. This system has been used successfully, but its performance is not always acceptable because of the combination of low turbine efficiency and high gearbox weight. For runs exceeding about four minutes, advanced technology electric motor/battery systems are superior to most other known systems.

The system described herein may be said to occupy a position midway between the solid propellant rocket and the geared turbine/propeller arrangement. It expands the propellant gases through a turbine, uses the turbine to drive a centrifugal sea water pump, and ejects the pumped water through tangential jets at the blade tips of a specially designed propeller. The propellant gases, after leaving the turbine, are ducted into a channel in the propeller blades concentric with the water channels to the tip jets such that the jet nozzles are aimed to squirt down the hollow cores of the ventilated tip vortices which form the mixing and compression region of the water jet gas eductors. In an alternative arrangement the exhaust gas from the turbine is released from the propeller hub at the blade trailing edges. Either arrangement for gas release provides a reduction in turbine back pressure which significantly increases turbine efficiency and reduces the sensitivity of the system to variations in operating depth.

It is an object of the present invention to provide a propulsion system for underwater vehicles which can provide specific power levels superior to those obtainable from any other underwater propulsion system for vehicles having a run time of between a few seconds and about two minutes. In this instance specific power is defined as the ratio of the propulsive power developed to overall motor and fuel weight. This may be contrasted with rocket propulsion systems which are capable of very high specific power levels and so are attractive for very short run times but have lower system specific energies, especially in longer runs, because of their very low propulsive efficiencies.

It is another object of the present invention to provide a propulsion system for underwater vehicles which incorporates the above advantage and which can be produced at relatively low cost.

It is another object of the present invention to provide a propulsion system for underwater vehicles which incorporates the above advantages and which has a very low level of reaction torque. This is a result of the tip jet propeller arrangement where the reaction force from the water jets is essentially directed to turning of the propeller. The only torque on the vehicle is that from friction in the thrust and guide bearings which is very small.

It is further object of the present invention to provide a propulsion system incorporating the above advantages and which has low self noise.

In the drawings,

FIG. 3 is a cross-sectional view taken along line 3—3 of FIG. 2;

FIG. 4 is a sectional view, showing the exhaust eductor with the ventilated tip vortex core;

FIG. 5 is a plan view of an alternate propeller tip configuration; and

FIG. 6 is a sectional view of the propeller configuration of FIG. 5, taken long line 6—6 of FIG. 5.

FIG. 7 is a graph showing a pressure-volume cycle diagram of the working gas in my propulsion system.

Figure 1:
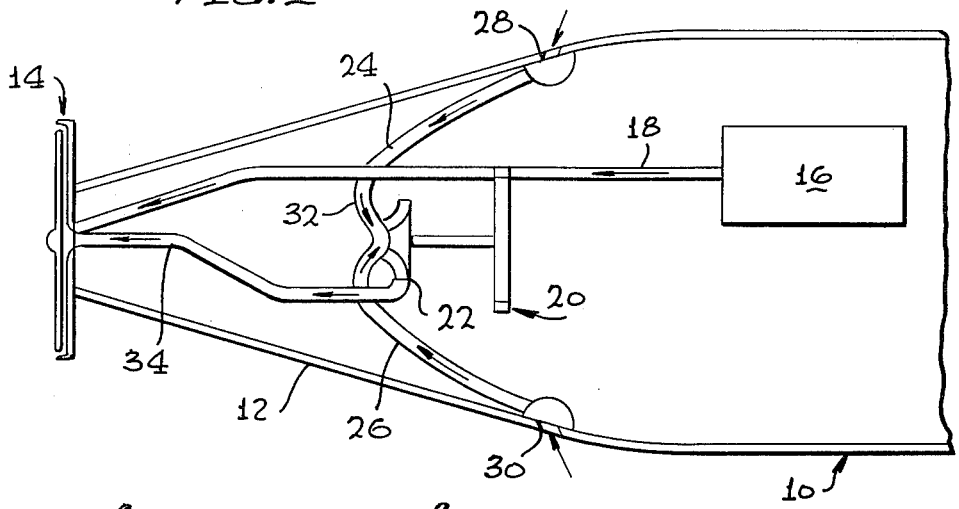
FIG. 1 is a schematic drawing of a propulsion system incorporating our invention and installed in a cylindrical underwater vehicle having a tapered afterbody.

Referring now to FIG. 1, an underwater vehicle is shown having a generally cylindrical housing 10 with a tapering afterbody 12. A propeller 14 is attached to the rear of afterbody 12. Carried within the housing 10 is a solid propellant gas generator 16 which supplies gaseous products of combustion through a conduit 18 such that they impinge upon and drive the blades of an axial flow turbine 20. After leaving the turbine, these gases continue to flow through conduit 18 to the rear of the afterbody 12 from which they are supplied to the propeller.

Turbine 20 is connected to drive a centrifugal pump 22 which is connected through a pair of ducts 24, 26 to a pair of water intake ports 28, 30, respectively, located on the surface of the afterbody 12 at, or immediately behind, the location where the afterbody 12 joins the main housing 10. This location for the intake ports facilitates induction of water from the inner region of the boundary layer, reducing inlet momentum drag and improving flow over the tapered afterbody. A scroll duct 32 brings the water to the inlet of pump 22 which is designed to suppress cavitation. Sea water discharged from pump 22 is carried through a conduit 34 to the hub of propeller 14 and from thence to radially directed passages in the blades which are connected to water jets in the propeller tips which discharge the sea water in such direction that the reaction force causes the propeller to turn.

Figure 2:
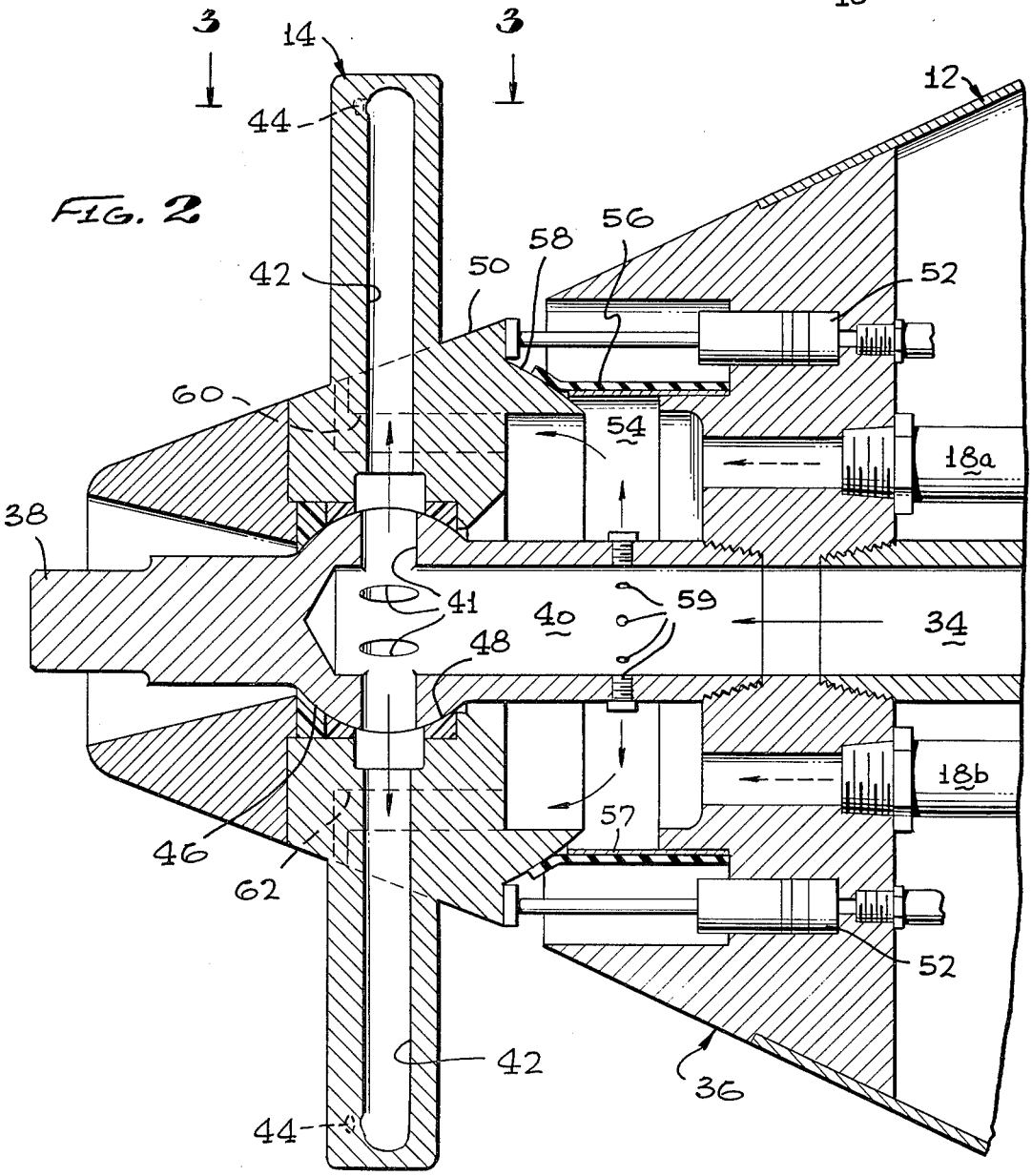
FIG. 2 is a cross-sectional drawing showing a tip jet propeller structure and actuating means such as might be used in the system of FIG. 1.

More detail of the propeller structure is shown in FIG. 2 which is a cross-section showing the water and gas passageways leading into the hub of propeller 14, the passageways in the hub and blades, the mounting structure for the hub, and actuation means for controlling the attitude of the hub and propeller to effect steering of the vehicle. A member 36 constitutes an extension of the tapered afterbody section 12 and is firmly attached thereto. Water inlet conduit 34 is threadedly engaged with a centrally disposed port in member 36, and a support shaft 38 is also threadedly engaged with said port and includes an internal bore 40 constituting an extension of the water inlet pipe 34. Bore 40 terminates in a plurality of radial ports 41 which direct sea water into passages 42 in the blades which connect to water jets or nozzles 44. Shaft 38 includes a large diameter spherical surface 46 near its center cooperating with mating bearing surfaces 48 forming part of the propeller hub 50 to form a ball-and-socket mounting means for the propeller 14 which permits the propeller to be tilted for steering of the vehicle so that no fins, rudder or elevators are necessary. Actuators 52 located in member 36 and connected to receive sea water under pressure from the pump 22 provide the required means for tilting hub 50 on ball 46. The particular control means for controlling the flow of water to and from actuators 52 forms no part of the present invention and has not been shown herein.

Also connected to bores in member 36 are a pair of gas inlet conduits 18*a* and 18*b* which supply the exhaust gases from the downstream side of the turbine 20 to an annular chamber 54 located between member 36 and hub 50 and which is further bounded by support shaft 38 and a flexible annular seal member 56 fixed to member 36 and which seals against a rotatable spherical surface 58 forming part of hub member 50. Seal 56 is supported from collapsing inwardly due to the ambient sea water pressure by means of an annular support 57 attached to member 36. Aligned with chamber 54 are a plurality of fine water discharge jets 59 which permit water from bore 40 to squirt into chamber 54 for the purpose of cooling the exhaust gas and condensing any condensable components such as steam in the exhaust gases in chamber 54. This significantly reduces the volume of exhaust gases which then flow into passages 60 and 62 in hub 50 and are directed overboard immediately behind the blades of the propeller 14. This gas is thereby discharged into a low pressure region creating a suction effect which minimizes back pressure on the turbine and aids the exhaust flow. This also serves to increase the operating depth of the associated vehicle since this depth tends to be limited by the ambient water pressure. The relative positions of the water and gas outlets may be clarified from FIG. 3 which is a sectional view taken along line 3—3 of FIG. 2. In this view the normal direction of movement of the propeller is in the direction of the arrow with the propeller pitch at angle theta, as indicated. The water passage 42 flows through the center of the blade, and the gas passageway 60 is visible in plan view such that the gas is discharged into the space immediately behind the blade, which is a low pressure region. The resulting flow pattern is shown in FIG. 4 which is a sectional view of the hub 50 and blades 14 with rotation of the blade in the direction of the arrow. The gas flow from passage 60, moving as shown by the arrows, tends to follow the trailing edge of the blade 14 toward the tip where it combines with the always present tip vortex from each of the blade tips ventilating its core and providing an effective helical pipe in the water down which the tip nozzle sprays.

In operation, the gas generated in generator 16 flows through conduit 18 and drives the turbine 20. Turbine 20 drives one or more centrifugal pumps 22 which induct sea water into intake ports 28 and 30, causing it to flow through conduits 24 and 26 to the pump and then, under pressure, through conduit 34 to the water inlet in member 36, to the radial ports 41, through blade passages 42 and to the nozzles 44 where the water is ejected with considerable force, creating a reaction force causing the blades to move as indicated in FIG. 3. Exhaust gas flowing from the turbine 20 through conduit 18 is divided into channels 18*a* and 18*b* from whence it flows into the annular chamber 54. In this chamber it is cooled by a spray of sea water from discharge jets 59 which condenses the steam and other condensable materials in the exhaust gas flow, thereby reducing its volume substantially. This permits the discharge passages 60 and 62 to be somewhat smaller than passages 18*a* and 18*b*. The exhaust flow from passages 60 and 62 flows into a low pressure region immediately behind the blade, as set forth above.

Water under pressure from the centrifugal pump or pumps 22 is supplied to the actuators 52 and the pressure in the individual actuators varied under the control of a control means, not shown, to cause the hub 50 to be tilted around the ball and socket joint on shaft 38 for steering. As the hub is moved to change the angle of the propeller, the seal 56 maintains contact against the spherical surface 58, thus retaining the exhaust gases in chamber 54 except for that flowing out of passages 60 and 62.

Although the overall efficiency of the specific propeller shown based on propeller thrust performance is quite good, when air compression work is added (representing exhaust recompression back to sea pressure in the complete system), the efficiency is somewhat greater. It should be noted that this exhaust gas or air compression work is accomplished by energy left in the water jets after they have left the propeller and therefore represents reclaimed energy. FIG. 7 shows the pressure-volume diagram for the propellant gas cycle, with the additional expansion of gas to a pressure below sea ambient pressure represented by the curved line segment C-D. Cooling and condensation of the condensables of the gas at this reduced pressure in the spray chamber is represented by line D-E and the recompression to sea pressure by line E-F. Since the areas on the diagram represent work, the extra amount of work obtained from the turbine in the p-v cycle, C-D-H-G, is greater than the compression work, E-F-G-H, by the ratio of the specific volume of the hot exhaust gas leaving the turbine D to that of the cold spray-washed, partially condensed gas leaving the propeller E.

If the condensables in the exhaust gas constitute 40%, this leverage ratio at typical operating depths is about 6:1. Thus for 50% overall efficiency, a 5% improvement in power output such as that obtained by gas compression as described above represents $6\times0.05\times0.50=15\%$ increase in thermal efficiency and, hence, in overall system efficiency. This effect, together with turbine windage benefits, is very beneficial in increasing system efficiency at depth.

FIG. 5 is a view, partly in section, of an alternate form of propeller blade 14*a* which provides for a somewhat different arrangement for discharging of the exhaust gases. In this embodiment, the water flows through a water passage 42 and is discharged from a nozzle 44 as in FIG. 2. The exhaust gas flow enters passages 60 and 62, as described above, but instead of being discharged at the base of the blade 14 it is ducted into passages 64 and 66 which are internal of blade 14 and which run parallel to water conduit 42, and is thereby discharged from the tips of the blades adjacent to the water nozzle 44. FIG. 6 is a sectional view of the blade 14*a* showing the water nozzle 44 and the ends of exhaust passages 64 and 66. A tip plate 68 is shown attached to the end of blade 14*a*. A vortical flow of gas at the blade tips is created into which the flow from the water nozzles 44 is discharged.

The energy in the jets after the flow leaves the propeller is used to actuate the eductors, so no reduction in tip driving power is experienced and jet absolute wake kinetic energy is utilized.

Various modifications will become apparent to those skilled in the art. While the above description has been in terms of two blades, etc., it is obvious that more blades may be used. In actuality, a propeller with four to six blades is the more usual configuration, this number being determined from studies within the skill of the art of propeller design. But no contra-rotating propeller arrangement is required to avoid reaction on the vehicle because of the absence of a drive shaft. The arrangement shown in FIG. 1 incorporates a single centrifugal pump, but a pair of smaller pumps, preferably on a common shaft on opposite sides of the turbine, is advantageous because of symmetrical intake of water around the vehicle housing, because of improved cavitation performance permitting operation at shallower depths, and because of higher pump efficiency. While the gas generator has been described in terms of a solid propellant gas generator, it is feasible to use a liquid propellant or other gas generator to drive the turbine. Also, while FIG. 1 shows only two water intake ports, more such ports, symmetrically arranged as in a circumferential crevass, may be employed to facilitate induction of water from the inner region of the boundary layer to improve flow over the circumference of the afterbody to reduce form drag on the vehicle. And although the ports 59 in member 40 provide the preferred means of injecting sea water into the exhaust gas flow, it is feasible to use other methods such as by means of ports in seal 56 and support member 57.

I claim:

1. In a propulsion system for an underwater vehicle having a propeller at the rear, a generally circular cross-section and an afterbody smaller in diameter from the maximum cross-section of said vehicle, said system including high pressure gas generating means, and a turbine driven by said high pressure gas characterized in that a series of water intake ducts are located on the surface of said vehicle at said afterbody, a pump is driven by said turbine and intake conduits are connected between said water intake ducts and said pump, a water discharge conduit connected between said pump and said propeller, a gas conduit connected between said turbine and said propeller, said propeller including a plurality of blades, at least some of which have radial water passages connected to said water discharge conduit, water jet nozzles near the tip of said blades for diverting the flow of water in an essentially tangential path from said tips to accelerate the water thereby providing a reaction force to rotate said propeller, gas flow passages connected to said gas conduit for discharging gas flow into a low pressure region adjacent said blades, and ports in said water discharge conduit permitting water to squirt into said gas conduit downstream of said turbine to condense condensable materials in said gas and to cool said gas.

2. A propulsion system as set forth in claim 1 wherein said blades also have gas flow passages connected to said gas conduit and parallel to said water passages for discharging said gas flow adjacent said water flow from said tips.

3. A propulsion system as set forth in claim 1 wherein said propeller is supported on a pipe including a ball and socket arrangement with the ball section constituting the end of said water discharge conduit, the socket forming part of said propeller and with radial ports in said ball section directing the flow of water to said radial water passages.

4. A propulsion system as set forth in claim 1 wherein control means are included for tilting said propeller relative to said vehicle for steering.

5. A propulsion system as set forth in claim 1 wherein an annular gas chamber is connected to said gas flow passages and positioned concentrically outside of a part of said water discharge conduit, and said ports in said water discharge conduit direct said water generally radially into said annular gas chamber.

* * * * *